US005965852A

United States Patent [19]

Roschke

[11] Patent Number: 5,965,852

[45] Date of Patent: Oct. 12, 1999

[54] ROADWAY SOUNDWALL AND SOUND-REDUCING MODULES USED THEREIN

[75] Inventor: Paul N. Roschke, Bryan, Tex.

[73] Assignee: The Texas A&M University System, College Station, Tex.

[21] Appl. No.: 09/078,688

[22] Filed: May 14, 1998

[51] Int. Cl.[6] ..... E04H 17/00

[52] U.S. Cl. ..... 181/210

[58] Field of Search ..... 181/210, 284, 181/285, 287, 288, 290, 291, 292, 294, 295; 52/144, 145

[56] References Cited

U.S. PATENT DOCUMENTS

| | | | |
|---|---|---|---|
| 4,143,495 | 3/1979 | Hintz | 52/145 |
| 4,214,411 | 7/1980 | Pickett . | |
| 4,566,558 | 1/1986 | Link, Jr. et al. | 181/210 |
| 4,899,498 | 2/1990 | Grieb | 52/144 |
| 5,268,540 | 12/1993 | Rex | 181/210 |
| 5,438,171 | 8/1995 | Schmanski | 181/210 |
| 5,521,338 | 5/1996 | Shono et al. . | |
| 5,537,788 | 7/1996 | Elmore et al. . | |
| 5,551,198 | 9/1996 | Schaaf et al. . | |
| 5,678,364 | 10/1997 | Shima et al. . | |
| 5,689,927 | 11/1997 | Knight, Sr. . | |
| 5,706,626 | 1/1998 | Mueller . | |
| 5,713,170 | 2/1998 | Elmore et al. . | |

*Primary Examiner*—Khanh Dang

*Attorney, Agent, or Firm*—Felsman, Bradley, Vaden, Gunter & Dillon, LLP

[57] ABSTRACT

A soundwall and components are described that incorporate a significant amount of plastic materials while still retaining the strength, durability and resiliency necessary for the soundwall to resist wind loads and weathering. An exemplary soundwall is described that is composed of prefabricated sound reducing modules anchored by support posts which are themselves constructed from a significant amount of plastics. The modules used in this exemplary wall are formed from an internal support frame which, in a preferred embodiment, is constructed from reinforced plastic lumber members. The support frame is covered by an outer sheath which, in alternative described embodiments, may be formed from reinforced plastic sheets or plastic lumber members. Methods are also described for fabricating the individual modules, support frame and support members as well as the soundwall itself. Soundwalls constructed in accordance with the present invention result in an unexpectedly great reduction in sound. The high plastic content of the soundwalls and their components permits greater amounts of recycled plastics rather than other materials to be used, thus providing environmental benefits as well.

18 Claims, 4 Drawing Sheets

ROADWAY SOUNDWALL AND SOUND-REDUCING MODULES USED THEREIN

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to roadway soundwalls and sound reducing modules for use in such soundwalls. The invention also relates to methods for constructing such soundwalls. In other aspects, the invention relates to systems and methods for reducing noise along a highway or roadway.

2. Description of the Related Art

Soundwalls are used alongside highways and other roadways to separate the roadway from residential subdivisions or communities. They serve to screen off the highway from view and provide a safety barrier between the community and the highway. Their primary purpose, however, is to significantly reduce traffic noise from the roadway within the community.

A typical roadway soundwall is from 8 to 18 feet in height and runs continuously alongside a selected section of roadway. Currently, soundwalls are constructed of wood, concrete or masonry block. Examples of such soundwalls are found in U.S. Pat. Nos. 5,713,170 and 5,537,788, both entitled "System and Method for Widening a Highway and Supporting a Sound Wall," and issued to Elmore et al. Soundwalls of this type are suitably sturdy and effective in reducing highway noise. However, they require a great deal of expensive material to construct. Further, when concrete or masonry block are used, the material is essentially a single use material and, upon destruction of the soundwall, the material cannot be recycled. It was estimated in 1995 that over 183 km (114 miles) of noise barriers or soundwalls have been constructed at a total cost of $141,000,000. R. Armstrong, "Highway Traffic Noise Barrier Construction Trends," *The Wall Journal,* v. 5, no. 27, pp. 6–9 (1996). In addition, soundwalls constructed of concrete, masonry block or another hard and massive material present a danger to vehicles which might leave the roadway and impact the soundwall.

Since the early 1990's, there have been attempts to incorporate greater amounts of recycled or recyclable materials into soundwall construction. These attempts have been largely unsuccessful and have not provided a soundwall with the features and advantages of the present invention. Several years ago, the Oregon Department of Transportation constructed a soundwall which used metal I-beam support columns. A number of lengths of unreinforced "boards" formed from recycled plastic were then stacked horizontally in between the support columns with the ends of the plastic boards resting within the recesses of the I-beams. A wall formed from a single layer of plastic resulted. The soundwall was tested to determine its durability to weathering. During this testing, significant warping of the boards occurred.

Recently, Carsonite International, Inc., a corporation based at 1301 Hot Springs Road, Carson City, Nev. 89706 constructed a composite soundwall which also incorporated recycled plastic. This soundwall employed steel support I-beam-type columns. Horizontally stacked between the support columns were lengths of composite members made up of recycled plastics covered with sheet metal shells.

It is noted that transparent acoustical panels are known that employ a single ¼" thick sheet of transparent polycarbonate, such as LEXAN®. Examples of such panels are described in U.S. Pat. No. 4,214,411 issued to Pickett. Panels of this nature are useful as a window or panel element within a concrete noise barrier, or within a rapid transit sound barrier canopy, or incorporation into other small barriers. However, these panels alone do not have the structural strength necessary to be used to form a larger soundwall.

SUMMARY OF THE INVENTION

The present invention describes a soundwall and components which incorporate a significant amount of plastic materials while still retaining the strength, durability and resiliency necessary for the soundwall to resist wind loads and weathering. An exemplary soundwall is described that is composed of prefabricated sound reducing modules affixed to and anchored by support posts which are themselves constructed from a significant amount of plastics. The modules used in this exemplary wall are formed from an internal support frame which, in a preferred embodiment, is constructed from reinforced plastic lumber members. The support frame is covered by an outer sheath which, in alternative described embodiments, may be formed from reinforced plastic sheets or plastic lumber members.

A soundwall is then created by slidingly inserting the modules between the support members which are preplaced into the ground at a desired location along a roadway. The modules are affixed to the support members so that the support members are hidden from view by the modules, thus presenting an aesthetically pleasing, unbroken appearance. If desired, the soundwall modules may be textured or etched with selected designs.

Methods are also described for fabricating the individual modules, support frame and support members.

Soundwalls constructed in accordance with the present invention result in an unexpectedly great reduction in sound. The high plastic content of the soundwalls and their components permits greater amounts of recycled plastics rather than other materials to be used, thus providing environmental benefits as well.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
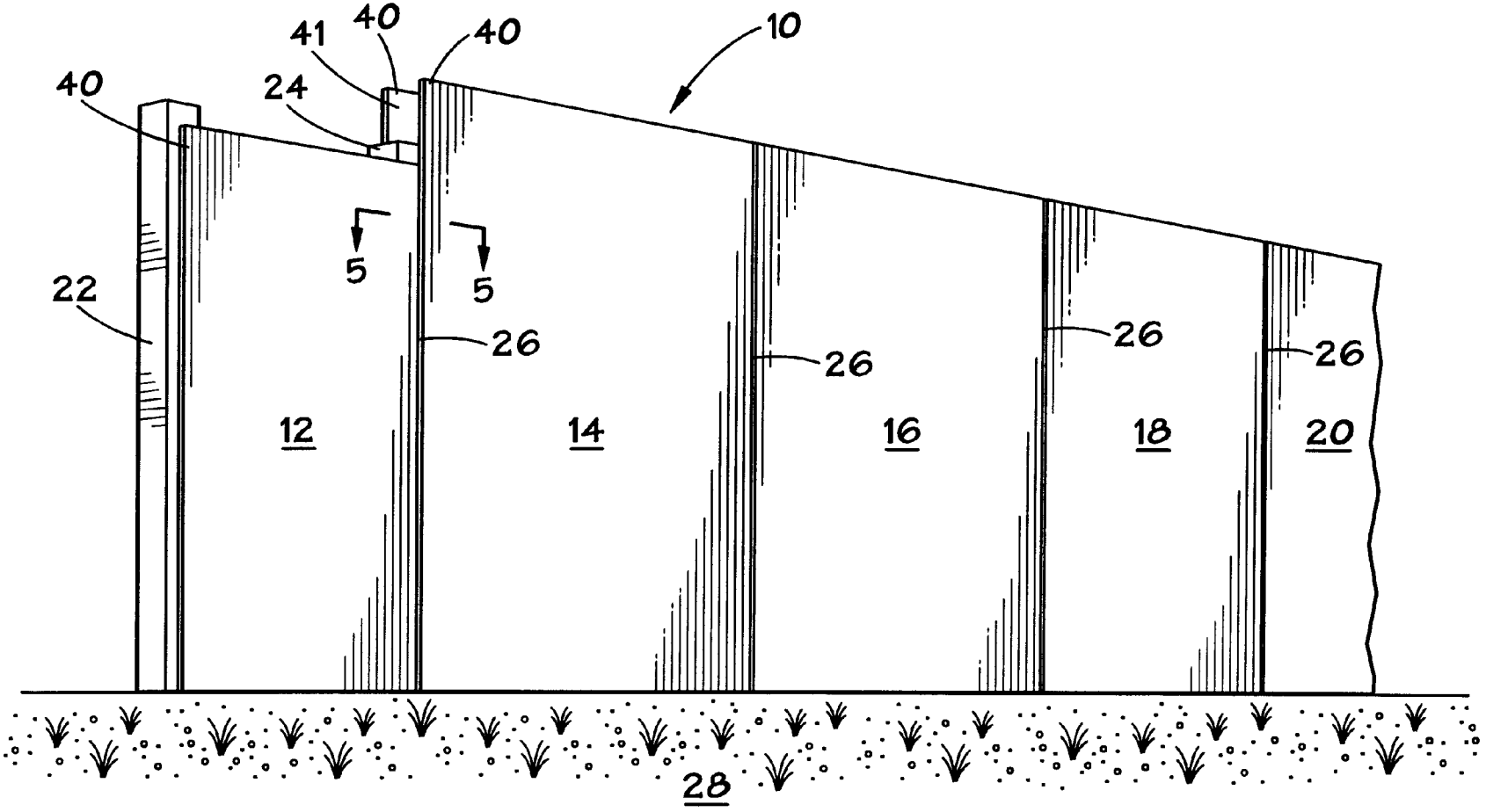
FIG. 1 depicts an exemplary soundwall constructed in accordance with the present invention.

Referring first to FIG. 1, an exemplary soundwall 10 is shown which is constructed in accordance with the present invention. The soundwall 10 is typically placed alongside a roadway (not shown), most often a highway, so that the soundwall is interposed between the highway and a residential community or other area where it is desired to reduce the amount of noise generated from traffic on the roadway. The considerations involved in placement of a soundwall are well known and will, therefore, not be described here.

Figure 4A:
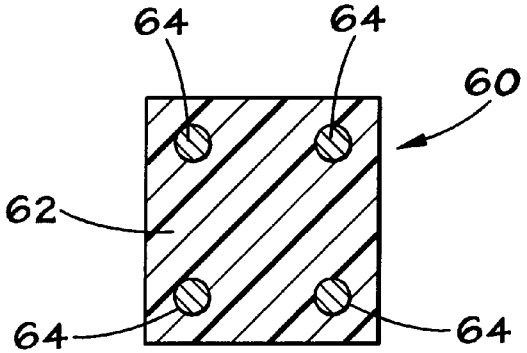
FIGS. 4A and 4B are cross-sectional views of alternative support members used in the soundwall of FIG. 1.
Figure 4B:
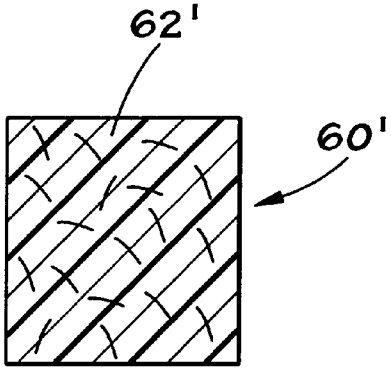

The soundwall 10 is made up of a number of modules 12, 14, 16, 18 and 20 and a number of vertically oriented longitudinal support members 22, 24 which serve essentially as posts to stand on either side of each module. The support members preferably have a square or rectangular cross-section, as is shown in FIGS. 4A and 4B.

Module 12 is shown as being shorter than modules 14, 16, 18 and 20 which assists in illustrating the placement of support post 24. It should be understood that there are support members similar to support members 22 and 24 which are not visible in FIG. 1. These support members are disposed between modules 14 and 16, 16 and 18, and 18 and 20.

As constructed, soundwall 10 presents a relatively smooth, unbroken surface to casual inspection. Seams 26 are shown to distinguish the edges of the modules. Support members which are located between modules, such as support member 24, will be essentially hidden from such viewing by the modules in a manner which will be described in further detail shortly.

The soundwall 10 is preferably of a height that is between 8 and 18 feet. It should be understood, however, that the soundwall and modules of the invention are not limited to any particular height or other dimensions.

The soundwall 10 rests upon the ground 28 in a selected location. The support members 22, 24 and others are disposed in the ground 28 and buried to a suitable depth. It is currently preferred that support members have at least ⅓ of their total length buried below ground. Thus, a support member having a total length of 18 feet would be buried so that 12 feet of length are disposed above ground and 6 feet of length are disposed underground. Preferably, concrete is placed around the support member to assist in firmly securing it.

Figure 2B:
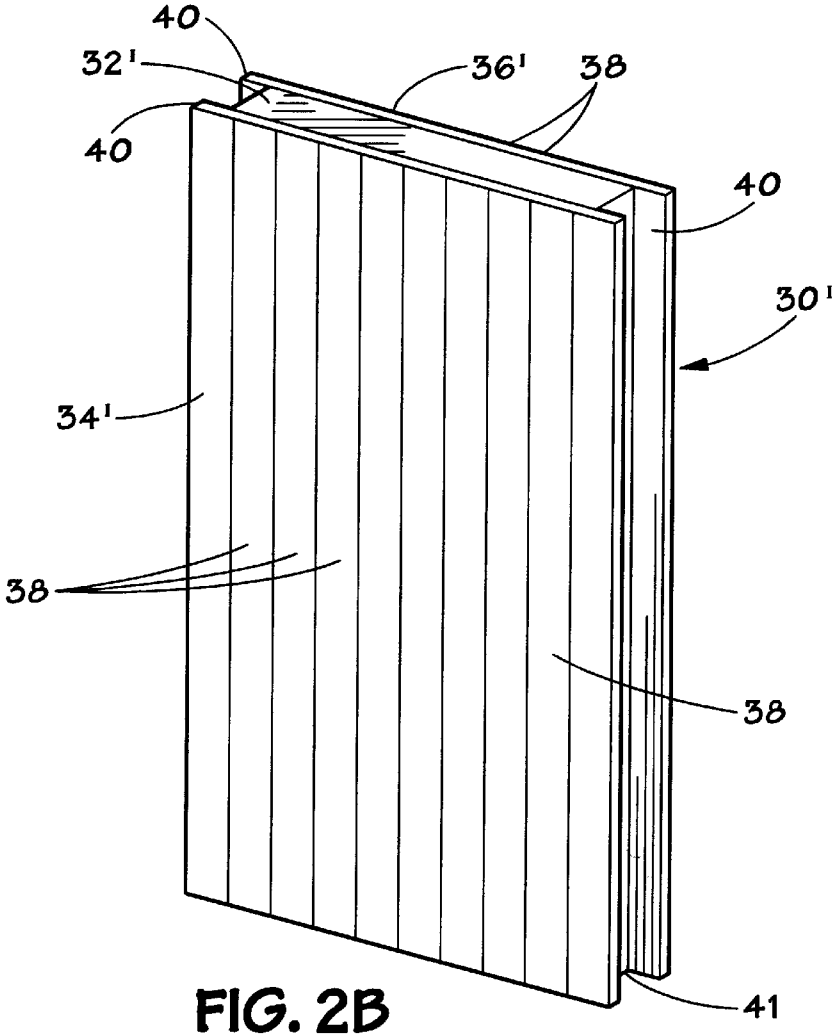
FIGS. 2A and 2B depict alternative exemplary sound reducing modules used in constructing the soundwall of FIG. 1.
Figure 2A:
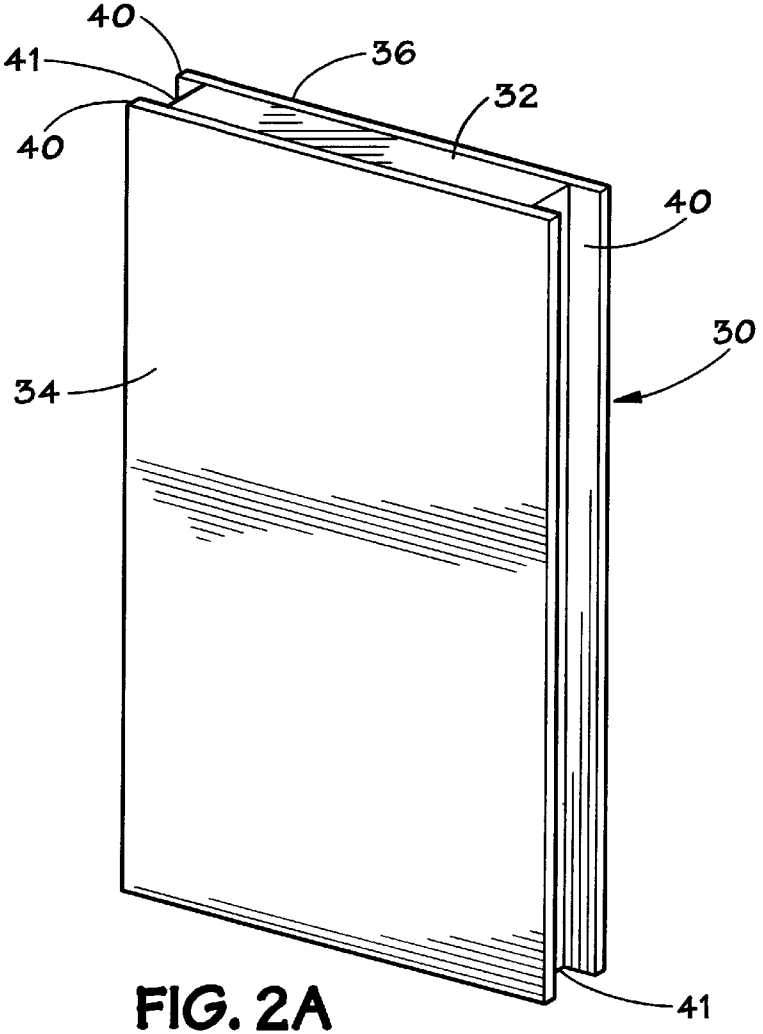

Referring now to FIG. 2A, one preferred embodiment of a sound reducing module 30 is illustrated. The sound reducing module 30 is of the type used as modules 12, 14, 16, 18 and 20 in FIG. 1. The sound reducing module 30 is generally rectangular in shape and includes an internal structural support frame 32 (only partly visible in FIG. 2A) which will be described in further detail shortly. An opaque front side outer sheath or covering 34 is disposed over the front side of the frame 32. Also, an opaque rear side outer sheath or covering 36 is disposed over the rear side of the frame 32. The sheaths 34 and 36 are each comprised of a sheet of plastic. A suitable and currently preferred reinforced plastic sheet for this application is a sheet composed of high-density polyethylene (HDPE) with a small percentage of ultraviolet light inhibitors. It is preferred, but not necessary that the plastic content be mostly, or even all, recycled plastics.

FIG. 2B depicts an alternative sound reducing module which is designated as 30'. This module also has an internal support frame 32' and front and rear side outer sheaths 34' and 36'. Each of the sheaths 34' and 36', however, are formed of plastic lumber members 38 rather than a sheet. The lumber members 38 are also formed of a high-density polyethylene plastic. Alternatively, the lumber members 38 may be formed from a fiberglass-reinforced plastic having the formulation described below for use in forming the alternative support member 60'.

It is noted that each of the modules 30, 30' are constructed so that the outer sheaths 34, 36, 34', 36' are wider than the support frame 32, 32' so that a protruding flange 40 is formed. The protruding flange 40 protrudes from the frame so that the amount of the protrusion approximates just slightly less than half the width of the support member, such as support member 24, which will stand alongside the module when installed in the soundwall 10. In a currently preferred embodiment, the amount of protrusion is approximately 4.5". A longitudinal channel 41 is formed between the two protruding flanges 40. Use of the protruding flange 40 to encase the support members 22, 24 is depicted in FIG. 1 and will be described further with respect to FIG. 5.

Figure 3:
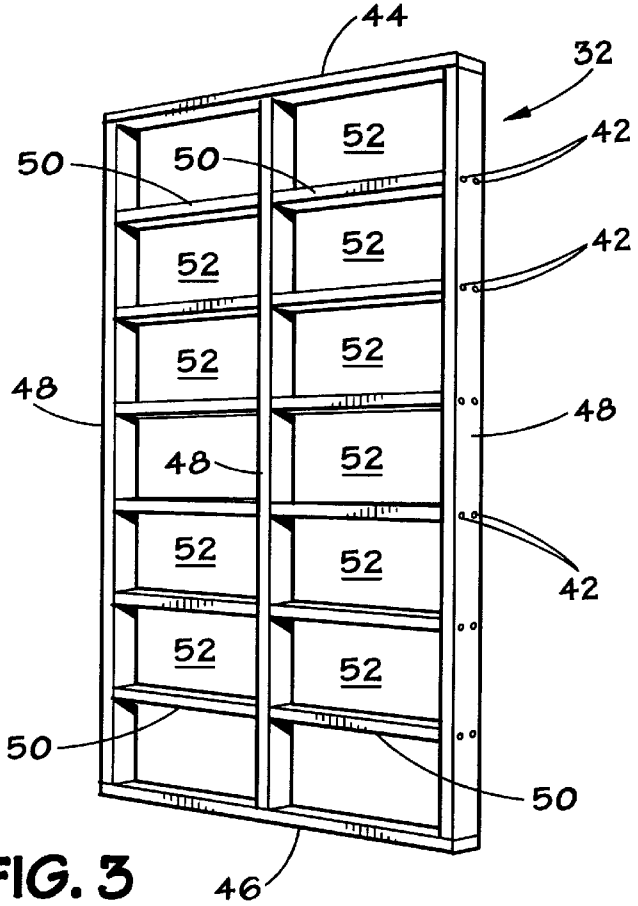
FIG. 3 illustrates a supporting frame which may be used in the sound reducing modules shown in FIGS. 2A and 2B.

Referring now to FIG. 3, an exemplary support frame 32 is depicted without outer sheaths 34, 36. The frame 32 is basically constructed of lengths of fiberglass-reinforced plastic lumber which are affixed to one another by suitable connectors such as nails or screws 42. Lengths of such reinforced plastic lumber are available from Enviro Specialty Products, Inc., P.O. Box 2714, Gulf Shores, Ala. 36547. Preferred nominal dimensions for the plastic lumber are 2"×9". The exemplary frame 32 is made up of upper and lower end caps 44, 46 and three vertically disposed studs 48. Supporting cross pieces 50 are affixed between the studs 48 for added strength. Voids 52 are formed between the structural members 44, 46, 48 and 50. Screws, ring-shank nails or other suitable connectors (not shown) are used to affix the front and rear outer sheaths 34, 36 or 34', 36' to the support frame 32. When the sheaths are affixed in this manner, the voids 52 become enclosed compartments.

It is believed that the enclosed compartments function to increase sound reduction by increasing the reflectivity coefficient of the soundwall. Reflectivity, one of the components of sound loss, is a measure of the intensity of the sound waves that are reflected in a direction opposite to their original direction of travel. It is surmised that the use of a pair of enclosing sheaths, such as 34 and 36, increases the reflectivity coefficient.

FIGS. 4A and 4B depict in cross-section, alternative embodiments for the support members, such as support members 22, 24 shown in FIG. 1. According to FIG. 4A, exemplary support member 60 is composed of a body 62 of a plastic, such as HDPE with four sections 64 of #8 reinforcing steel ("rebar") disposed along the length of the body 62. FIG. 4B shows alternative support member 60' which has a body 62' that is made up of a fiberglass-reinforced HDPE plastic. A preferred formulation for the fiberglass-reinforced plastic is approximately 805 HDPE and 205 loose fiberglass.

Figure 5:
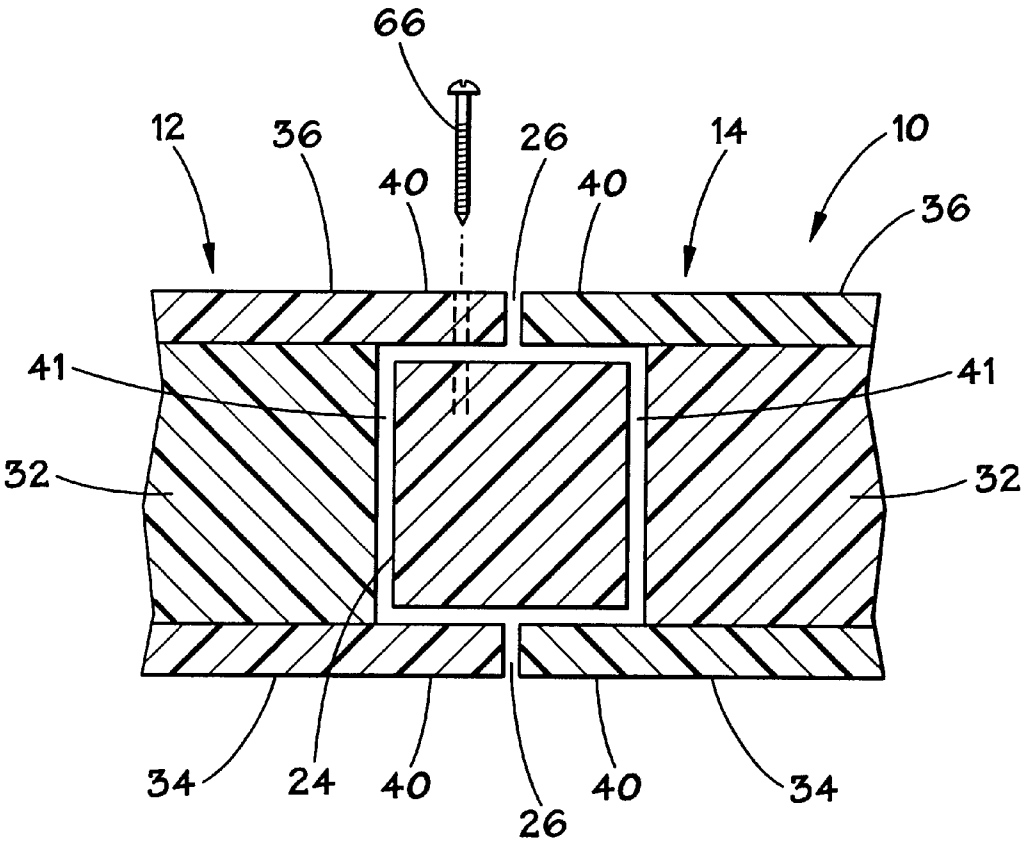
FIG. 5 is a detail cross-section showing the manner of affixing a pair of sound reducing modules to a support member.

FIG. 5 shows a cutaway to view (along lines 5—5 in FIG. 1) of a portion of the soundwall 10. Specifically depicted is the support member 24 and the edges of modules 12 and 14.

Spacing and dimensions in FIG. 5 are exaggerated for ease of illustration of the relationship of the components to one another. As shown, the support member 24 is received within the longitudinal channel 41 of each module 12, 14. The flanges 40 from each of the modules 12, 14 overlap and partially cover the support member 24 from view, resulting in a seam 26 which is relatively small. It may be possible to form a perfect complimentary fit between the support member 24 and the longitudinal channel 41. However, for ease of installation, small gaps are acceptable and even desirable. When assembled in this manner, then, the seam 26 becomes essentially invisible to casual inspection and the support member 24 is essentially hidden from view. As a result, the soundwall 10 presents an essentially continuous, unbroken surface.

A single connector 66 is shown which is used to affix the flanges 40 of the modules 12, 14 to the support member 24. It should be understood that multiple connectors 66 should actually be used to secure each flange 40 to the support member 24. Suitable connectors include screws and ring-shank nails. Bolts with nuts may also be used as connectors, but these are less aesthetically pleasing. The support members are enclosed by the wall panels to improve the aesthetics of the wall.

A soundwall which is constructed as described is significantly safer than soundwalls constructed from a massive material such as concrete or masonry brick. There are no massive or non-yielding surfaces present, as is the case for example with a concrete or masonry, which would cause a vehicle to be stopped cold, resulting in lethal deceleration to the vehicle occupants.

Sound tests conducted with a prototype soundwall have demonstrated that an unexpectedly great amount of sound reduction results from soundwalls and sound reducing modules constructed in accordance with the present invention. In a test conducted with the prototype wall constructed at the Riverside Campus, sound insertion loss was predicted by the Federal Highway Administration's STAMINA (Standard Method in Noise Analysis) computer program for sounds generated on one side of the prototype wall and detected by a sound meter on the other side of the wall. The insertion loss is a measurement of the sound reaching a sound meter regardless of whether the sound passes through, over, or around the wall. The STAMINA program estimated the insertion loss to be 12.2 dBA. Actual measured insertion loss, however, proved to be 17.1 dBA—an unexpectedly greater amount. It is suspected that the presence of the compartments formed by the enclosed voids 52 of the module's frame 32 are at least part of the reason for the unexpected benefit.

Construction of a soundwall, such as soundwall 10, is preferably accomplished as follows. A desired location, or site, for the soundwall is identified, and the site is then prepared by removal of trees, plants, debris, or other objects. If necessary, the site may be leveled. It is preferred that a concrete base be placed for the soundwall to be seated upon. Next, the locations for holes for the support members are identified and marked, and these holes are then excavated. The locations for the holes are based upon the width of the modules to be used in constructing the soundwall. Support members are then placed within the holes and secured in a vertical orientation. If concrete is used, the concrete is allowed to cure. Accurate measurement of the distance between the holes and support members is important.

Figure 6:
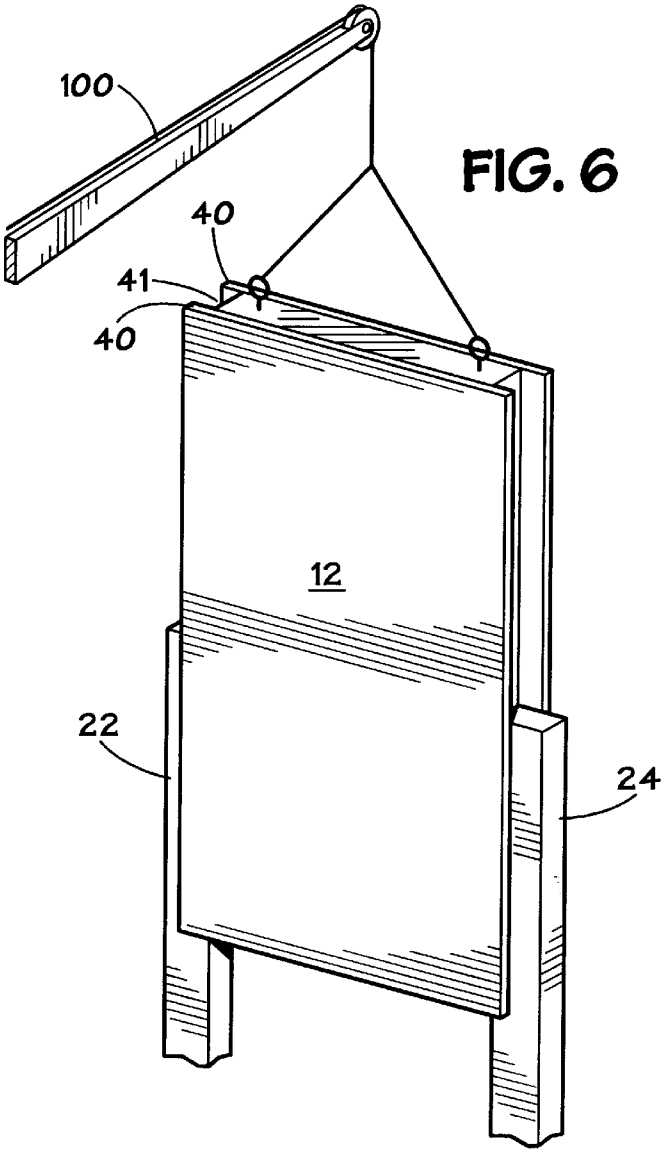
FIG. 6 depicts aspects of constructing a portion of a soundwall.

Prefabricated sound reducing modules are then delivered to the site. As FIG. 6 illustrates a crane or other suitable lifting device 100 is used to slidingly insert the modules (such as module 12 in FIG. 6) between the support members (such as support members 22 and 24 in FIG. 6) so that the support members are essentially covered by the protruding flanges 40 of the modules. In order to slidingly insert a module between two support members, the module is lifted so that the lower end of the modules is at a height above the upper ends of the support members. The longitudinal channels 41 of the module are then aligned with the support members. The module is lowered so that the support members are slidingly disposed into the channels 41. Connectors 66 are then used to secure the flanges to the support members.

If desired, with the exception of a modest number of connectors and reinforcing members, the soundwall 10 can be made up entirely of recycled plastics. Also, if desired, designs may be etched, engraved, stamped or otherwise placed on the surface of the modules.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A soundwall for use in ground along a roadway, the soundwall comprising:

a) a generally vertically oriented support member which is disposed in the ground;

b) a sound reducing module supported by the support member, the sound reducing module comprising:

1) a support frame formed of reinforced plastic; and 2) an outer sheath covering a portion of the support frame, the outer sheath being formed of plastic.

2. The soundwall of claim 1 wherein the reinforced plastic forming the support frame consists essentially of approximately 80% HDPE and 20% loose fiberglass.

3. The soundwall of claim 1 wherein the support frame is comprised of a plurality of plastic lumber members.

4. The soundwall of claim 1 wherein the outer sheath comprises a plastic sheet.

5. The soundwall of claim 1 wherein the outer sheath comprises a plurality of plastic lumber members.

6. A soundwall for use along a roadway, the soundwall comprising:

a) a generally vertically oriented support member having a rectangular cross-section;

b) a pair of generally rectangular sound reducing modules supported by and essentially hiding the support member from view, the sound modules each presenting a longitudinal channel to receive said support member; and c) the sound modules constructed of a material consisting essentially of HDPE and loose fiberglass.

7. The soundwall of claim 6 wherein the longitudinal channel is defined between a pair of protruding flanges which extend from an end of the module.

8. The soundwall of claim 7 further comprising a means for securing the protruding flange of the module to the support member.

9. The soundwall of claim 6 wherein the pair of modules are each formed of a structural support frame at least partially covered by an outer sheath.

10. A sound reducing module for use in a soundwall comprising:

a) a generally rectangular support frame formed of reinforced plastic;

b) a plurality of voids formed within the frame; and c) a pair of outer sheaths each covering a portion of the support frame and said voids to create sound reducing compartments within the frame.

11. The module of claim 10 wherein each outer sheath protrudes beyond an edge of the frame to form a pair of protruding flanges.

12. The sound reducing module of claim 11 wherein a longitudinal channel is defined between the protruding flanges.

13. The sound reducing module of claim 10 wherein the reinforced plastic forming the support frame consists essentially of approximately 80% HDPE and 20% loose fiberglass.

14. The sound reducing module of claim 10 wherein the outer sheaths are formed of a material which consists essentially of approximately 80% HDPE and 20% loose fiberglass.

15. A method for constructing a soundwall in a selected ground location, comprising:

a) disposing a pair of longitudinal support members within the ground, each in a vertical orientation;

b) locating a first sound reducing module between the support members such that each of the support members is at least partially received within a longitudinal channel in the module.

16. The method of claim 15 wherein the step of locating a sound reducing module comprises:

a) lifting the first module until a lower end of the first module is at a height above the ground which exceeds the height of the support members;

b) aligning the support members with the longitudinal channels of the first module; and c) lowering the first module to slidingly dispose the support members within the longitudinal channels of the first module.

17. The method of claim 15 further comprising the step of anchoring the first module to the support members using at least one connector.

18. The method of claim 15 further comprising locating a second module adjacent the first module so that a longitudinal channel of the second module at least partially receives a portion of one of said support members, said support member being substantially hidden within the longitudinal channels of the first and second modules.

* * * * *